US012800215B2

(12) United States Patent
Jung et al.

(10) Patent No.: US 12,800,215 B2
(45) Date of Patent: Nov. 17, 2026

(54) ICE MAKING APPARATUS AND ICE MAKING WATER PURIFIER INCLUDING THE SAME

(71) Applicant: COWAY Co., Ltd., Gongju-si (KR)

(72) Inventors: Woong Jung, Seoul (KR); Hyun Suk Moon, Seoul (KR); Min Su Song, Seoul (KR); Jae Man Kim, Seoul (KR)

(73) Assignee: COWAY Co., Ltd., Gongju-si (KR)

( * ) Notice: Subject to any disclaimer, the term of this patent is extended or adjusted under 35 U.S.C. 154(b) by 96 days.

(21) Appl. No.: 18/609,998

(22) Filed: Mar. 19, 2024

(65) Prior Publication Data

US 2024/0318888 A1 Sep. 26, 2024

(30) Foreign Application Priority Data

Mar. 21, 2023 (KR) ..... 10-2023-0036392

(51) Int. Cl.
*F25C 5/08* (2006.01)
*F25C 1/045* (2018.01)
*F25C 1/25* (2018.01)

(52) U.S. Cl.
CPC ..... *F25C 5/08* (2013.01); *F25C 1/045* (2013.01); *F25C 1/25* (2018.01); *F25C 2400/14* (2013.01)

(58) Field of Classification Search
CPC ..... F25C 1/045; F25C 1/25; F25C 2400/14; F25C 2305/0221
See application file for complete search history.

(56) References Cited

U.S. PATENT DOCUMENTS 4,505,130 A * 3/1985 Hibino ..... F25C 1/045 62/347
4,910,974 A * 3/1990 Hara ..... F25C 1/045 62/352
2013/0081412 A1* 4/2013 Son ..... F25C 5/04 62/340
2014/0165623 A1* 6/2014 Guarino ..... F25C 1/24 62/340
2022/0412630 A1* 12/2022 Mitchell ..... F25C 1/25

FOREIGN PATENT DOCUMENTS

CN 214469490 U * 10/2021
JP H01102266 A * 4/1989

OTHER PUBLICATIONS

Translated_Yuasa (Year: 1989).*
Translated_Guo (Year: 2021).*

* cited by examiner

*Primary Examiner* — Jerry-Daryl Fletcher
*Assistant Examiner* — Samba Gaye
(74) *Attorney, Agent, or Firm* — Oblon, McClelland, Maier & Neustadt, L.L.P.

(57) ABSTRACT

An ice making apparatus comprises: a frame assembly includes a support frame and a rotation frame rotatably connected to the support frame; and one or more ice making cells that produce ice. The ice making cell includes an upper ice making cell that covers a portion of the ice and is supported on the support frame, and a lower ice making cell that covers another portion of the ice and is supported on the rotation frame. The rotation frame includes a water to melt ice flowing portion having a water to melt ice flow path through which water to melt ice at a higher temperature than the ice in the lower ice making cell flows.

7 Claims, 9 Drawing Sheets

"II"

"III"

ICE MAKING APPARATUS AND ICE MAKING WATER PURIFIER INCLUDING THE SAME

TECHNICAL FIELD

The present disclosure relates to an ice making apparatus and an ice making water purifier including the same.

BACKGROUND

In general, ice makers may produce ice having shapes such as polygons or hemispheres. Recently, ice makers have been developed that produce circular ice that may give consumers a sense of aesthetics. Such an ice maker may be provided with an ice making frame that produces ice and a separation device that separates the ice from the ice making frame.

Korean Patent Application Publication No. 10-2022-0037823 (Patent Document 1), entitled "Ice maker for producing spherical or polyhedral ice, and drinking water supply apparatus and refrigerator having same", filed by the applicant Chung Ho Nais Co., Ltd., discloses an upper ice making frame that produces an upper portion of ice; a lower ice making frame that produces a lower portion of the ice; and a first refrigerant flow path formed between the upper ice making frame and an evaporator cover. However, the ice maker of Patent Document 1 detaches ice from the upper ice making frame by flowing hot gas through the first refrigerant flow path or heating the evaporator cover or the upper ice making frame with a heater to melt the surface of the ice. Accordingly, the ice maker of Patent Document 1 needs to be provided with a separate flow path for supplying not only refrigerant but also hot gas to the first refrigerant flow path in order to detach ice from the ice maker. In addition, since a separate heater needs to be mounted to detach the ice, the structure of the ice maker becomes complicated and the volume of the ice maker increases.

Accordingly, there is a need for an ice making apparatus that simplifies the structure and allow ice to be easily detached from an ice making cell.

RELATED ART DOCUMENT

Patent Document (Patent Document 1) Korean Patent Application Publication No. 10-2022-0037823 (publication date: Mar. 25, 2022)

SUMMARY

In view of the above, the present disclosure provides an ice making apparatus that simplifies the structure and allow ice to be easily detached from a plurality of ice making cells by forming a water to melt ice flow path through which water to melt ice flows along the circumference of the ice making cells and an ice making water purifier including the ice making apparatus.

In an embodiment of the present disclosure, an ice making apparatus comprises a frame assembly including a support frame and a rotation frame rotatably connected to the support frame; and one or more ice making cells that produce ice, wherein the ice making cell includes an upper ice making cell that covers a portion of the ice and is supported on the support frame, and a lower ice making cell that covers another portion of the ice and is supported on the rotation frame; and wherein the rotation frame includes a water to melt ice flowing portion having a water to melt ice flow path through which water to melt ice at a higher temperature than the ice in the lower ice making cell flows.

Further, the lower ice making cell and the water to melt ice flowing portion may be provided in plural numbers; wherein the plurality of water to melt ice flowing portions are extended along a circumference of the plurality of lower ice making cells; and wherein the rotation frame further includes a communication portion that provides a passage through which at least some of the plurality of water to melt ice flowing portions communicate with each other.

Further, the lower ice making cell may include: a non-contact portion that is inserted into the rotation frame so as not to be exposed to water to melt ice; and a contact portion disposed on an upper side of the non-contact portion to contact water to melt ice, and wherein the water to melt ice flowing portion surrounds at least a portion of the contact portion.

Further, a height of the contact portion may be higher than a water level of water to melt ice in the water to melt ice flowing portion.

Further, the rotation frame may further include an outlet providing a passage for water to melt ice flowing in the water to melt ice flowing portion to be discharged from the water to melt ice flowing portion to an outside of the rotation frame.

Further, the rotation frame may include: a water to melt ice accommodation portion that accommodates water to melt ice supplied from an outside; and a guide portion that guides the water to melt ice in the water to melt ice accommodation portion to flow to the water to melt ice flowing portion.

Further, the rotation frame may further include a barrier disposed between the water to melt ice accommodation portion and the water to melt ice flowing portion to extend to both sides of the guide portion.

Further, the water to melt ice accommodation portion may be disposed at a higher position than the water to melt ice flowing portion.

Further, an ice making water purifier may comprise an ice making apparatus that produces ice; and a filter that filters raw water to provide purified water to produce the ice, wherein the ice making apparatus comprises: a frame assembly including a support frame and a rotation frame rotatably connected to the support frame; and one or more ice making cells that produce a part of the ice, wherein the ice making cell includes an upper ice making cell that covers a portion of the ice and is supported on the support frame, and a lower ice making cell that covers another portion of the ice and is supported on the rotation frame, and wherein the rotation frame includes a water to melt ice flowing portion having a water to melt ice flow path through which water to melt ice at a higher temperature than the ice in the lower ice making cell flows.

Further, an ice making water purifier may further comprise: a main tank accommodating water to melt ice to be provided to the ice making apparatus; and an auxiliary tank in communication with the main tank, wherein the rotation frame further includes an outlet providing a passage for water to melt ice flowing in the water to melt ice flowing portion to be discharged from the water to melt ice flowing portion to an outside of the rotation frame, and wherein the auxiliary tank accommodates water to melt ice discharged from the outlet, and when the water to melt ice exceeds a preset capacity, the excess water to melt ice flows from the auxiliary tank to the main tank.

Further, the rotation frame may further include a water to melt ice accommodation portion that accommodates water to melt ice supplied from an outside, and wherein the ice making water purifier further comprises: a nipple that receives water to melt ice through the main tank and supplies the received water to melt ice to the water to melt ice accommodation portion; and a circulation channel that provides a path for the water to melt ice to flow from the main tank to the nipple.

Further, the water to melt ice flowing portion adjacent to the nipple may be disposed at a higher position than the water to melt ice flowing portion adjacent to the outlet.

DETAILED DESCRIPTION

Hereinafter, specific embodiments for implementing a technical idea of the present disclosure will be described in detail with reference to the drawings.

In addition, in describing the present disclosure, when it is determined that a detailed description of a related known technology or function may obscure the gist of the present disclosure, the detailed description thereof will be omitted.

When an element is referred to as being 'connected' to, 'supported' by, 'flowed' to, 'supplied' to, and 'flowed' out by another element, it should be understood that the element may be directly connected to, supported by, flowed to, supplied to, and flowed out by the other element, but that other elements may exist in the middle.

The terms used in the present disclosure are only used for describing specific embodiments, and are not intended to limit the present disclosure. Singular expressions include plural expressions unless the context clearly indicates otherwise.

In addition, terms including ordinal numbers, such as first and second, may be used for describing various elements, but the corresponding elements are not limited by these terms. These terms are only used for the purpose of distinguishing one element from another element.

As used in the specification, it is to be understood that the terms such as "including" are intended to indicate the existence of certain features, areas, integers, steps, actions, elements, and/or components, and are not intended to preclude the possibility that other certain features, areas, integers, steps, actions, elements, components, and/or groups thereof may exist or may be added.

In addition, in the present specification, expressions for directions such as upward and downward are described based on the drawings, and it is said in advance that they may be expressed differently when the direction of the object is changed. In the present specification, an up and down direction may be the up and down direction of FIGS. 1 and 2.

Hereinafter, a specific configuration of an ice making water purifier 1 according to one embodiment of the present disclosure will be described with reference to the drawings.

Figure 1:
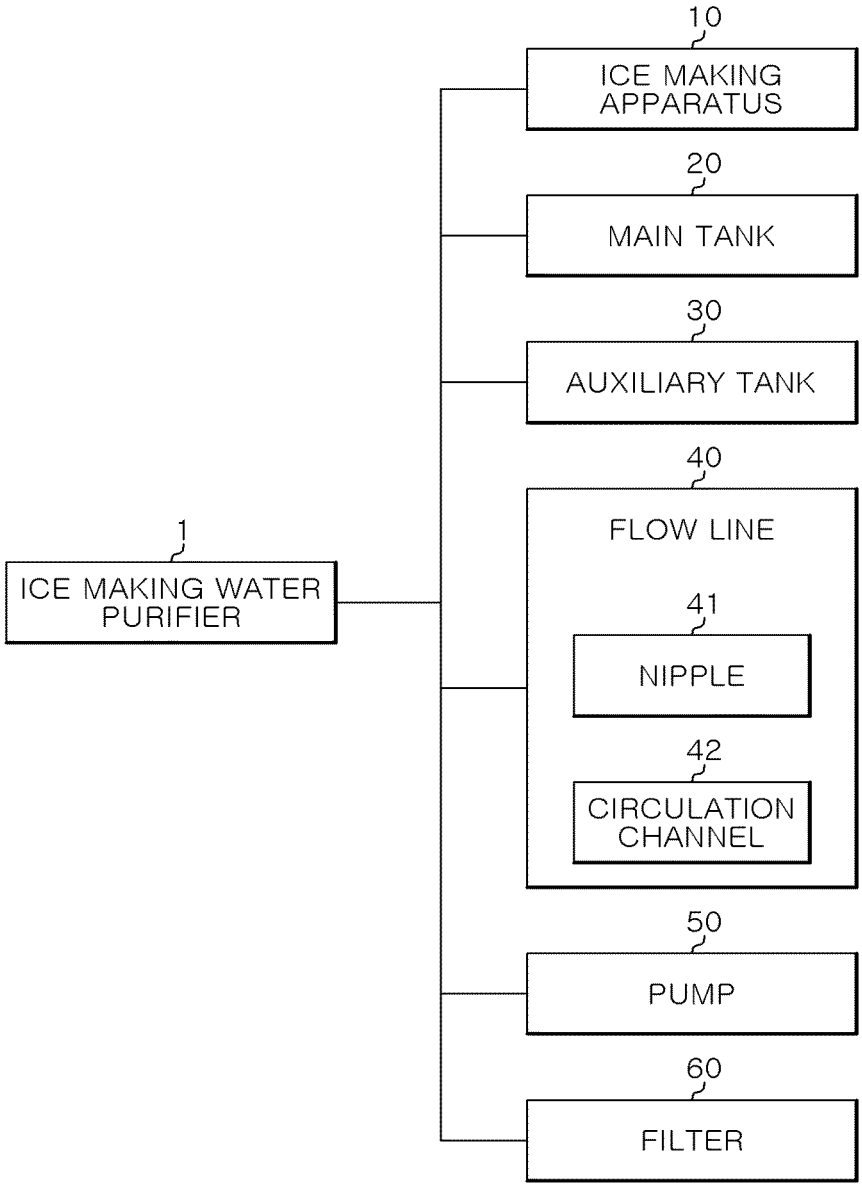
FIG. 1 is a schematic diagram illustrating the configuration of an ice making water purifier according to one embodiment of the present disclosure.
Figure 2:
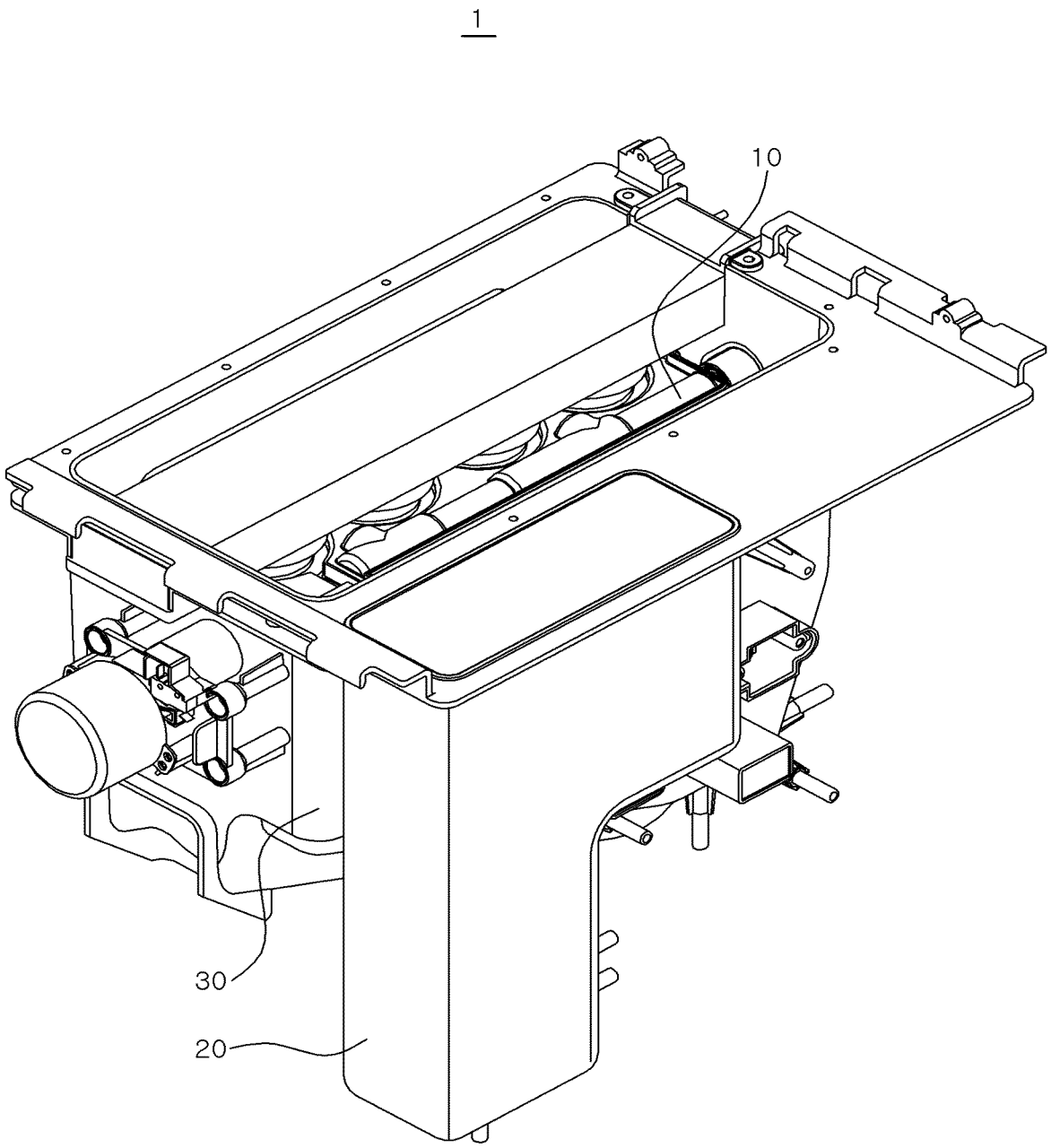
FIG. 2 is a perspective view of the ice making water purifier according to one embodiment of the present disclosure.
Figure 3:
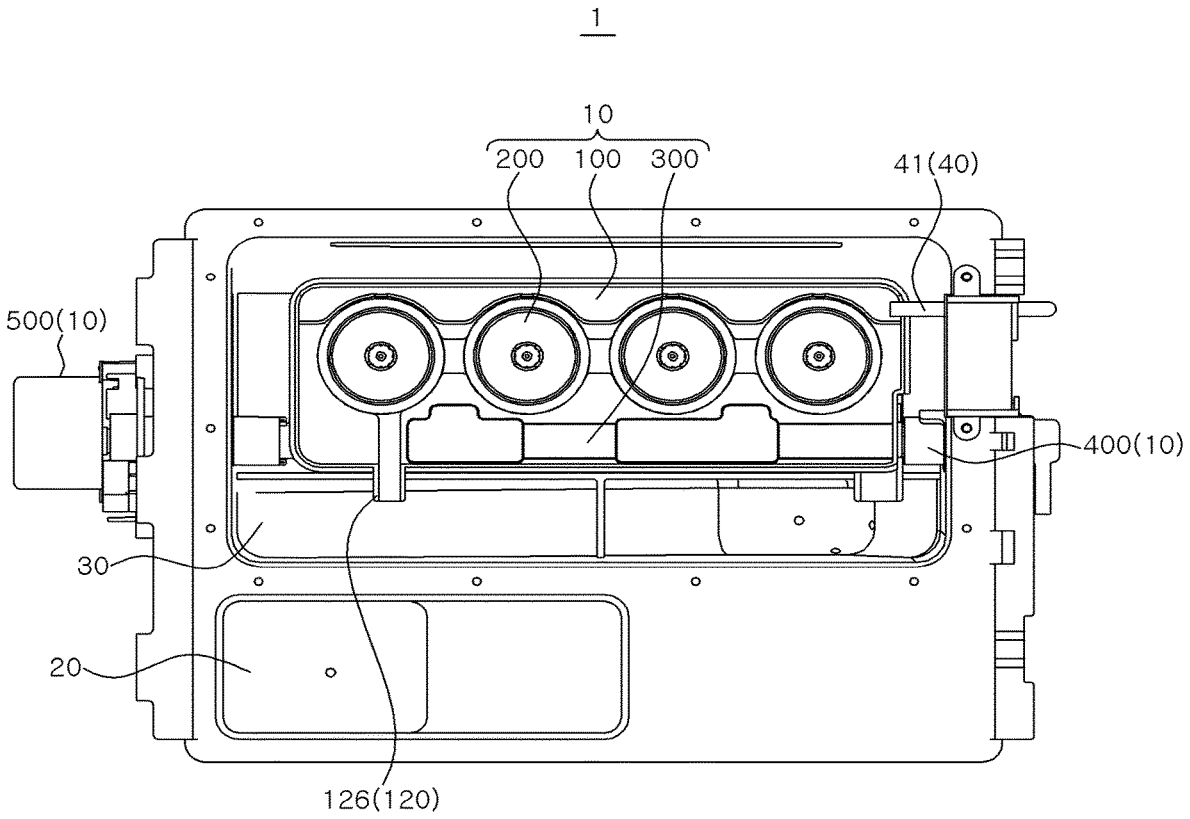
FIG. 3 is a view of the ice making water purifier of FIG. 2 viewed from an upper side thereof.
Figure 4:
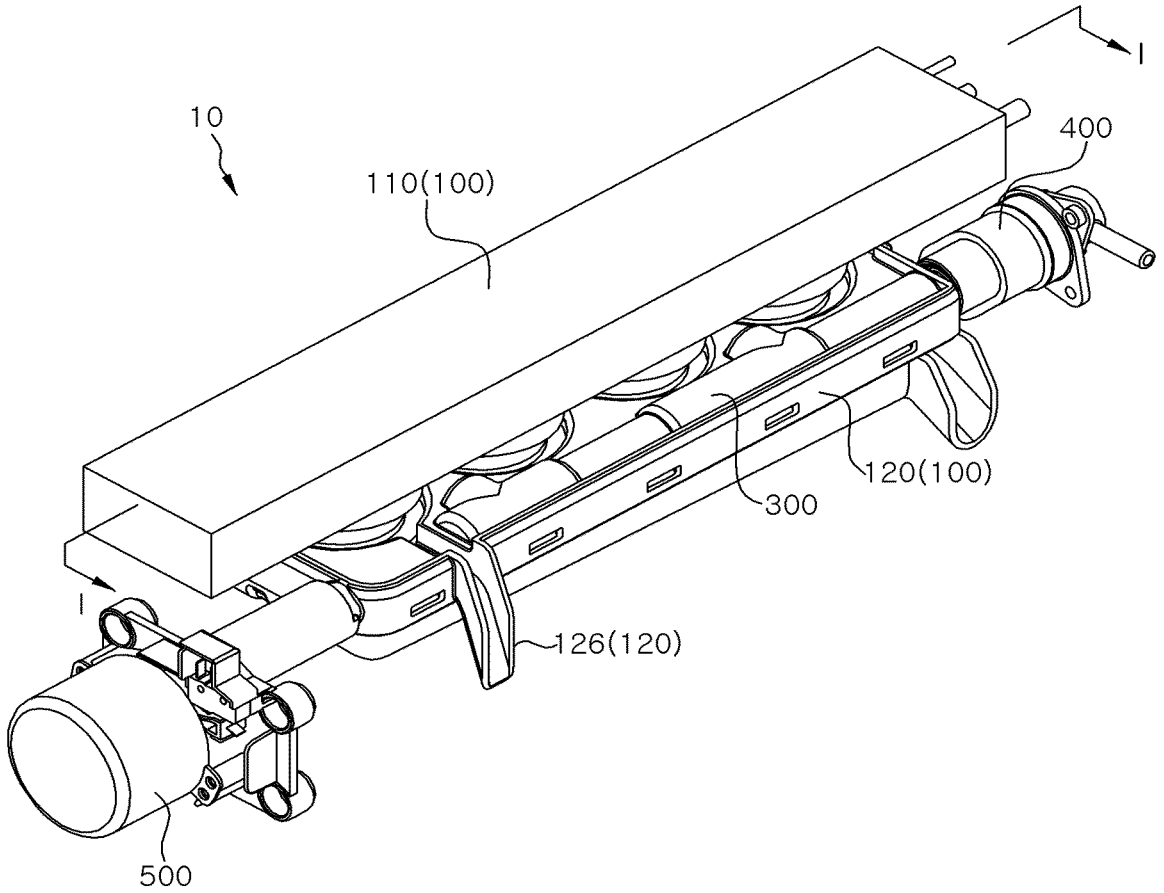
FIG. 4 is a perspective view of an ice making apparatus of the ice making water purifier of FIG. 2.
Figure 5:
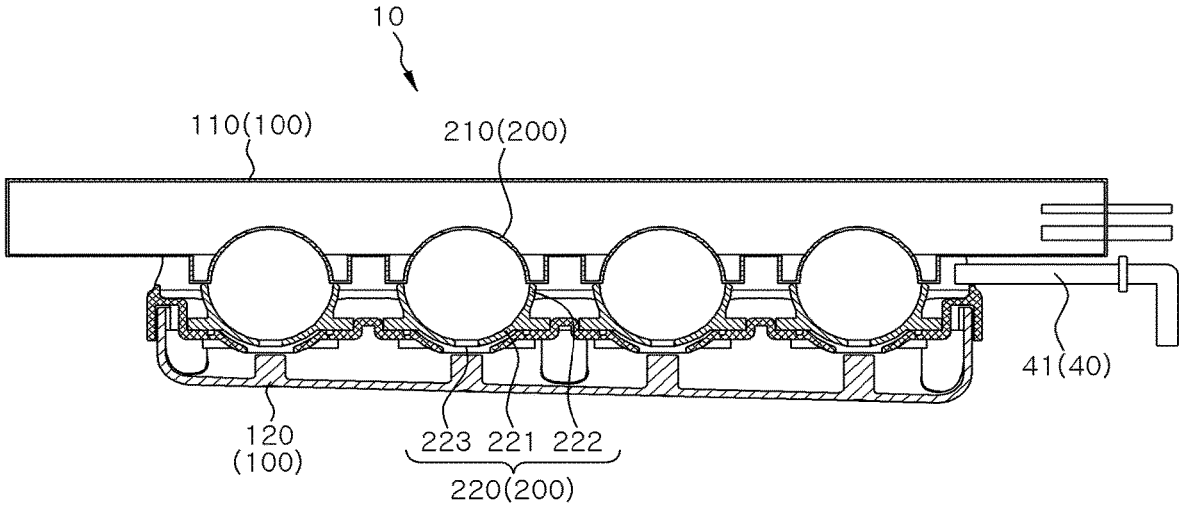
FIG. 5 is a cross-sectional view taken along line I-I of FIG. 4.
Figure 6:
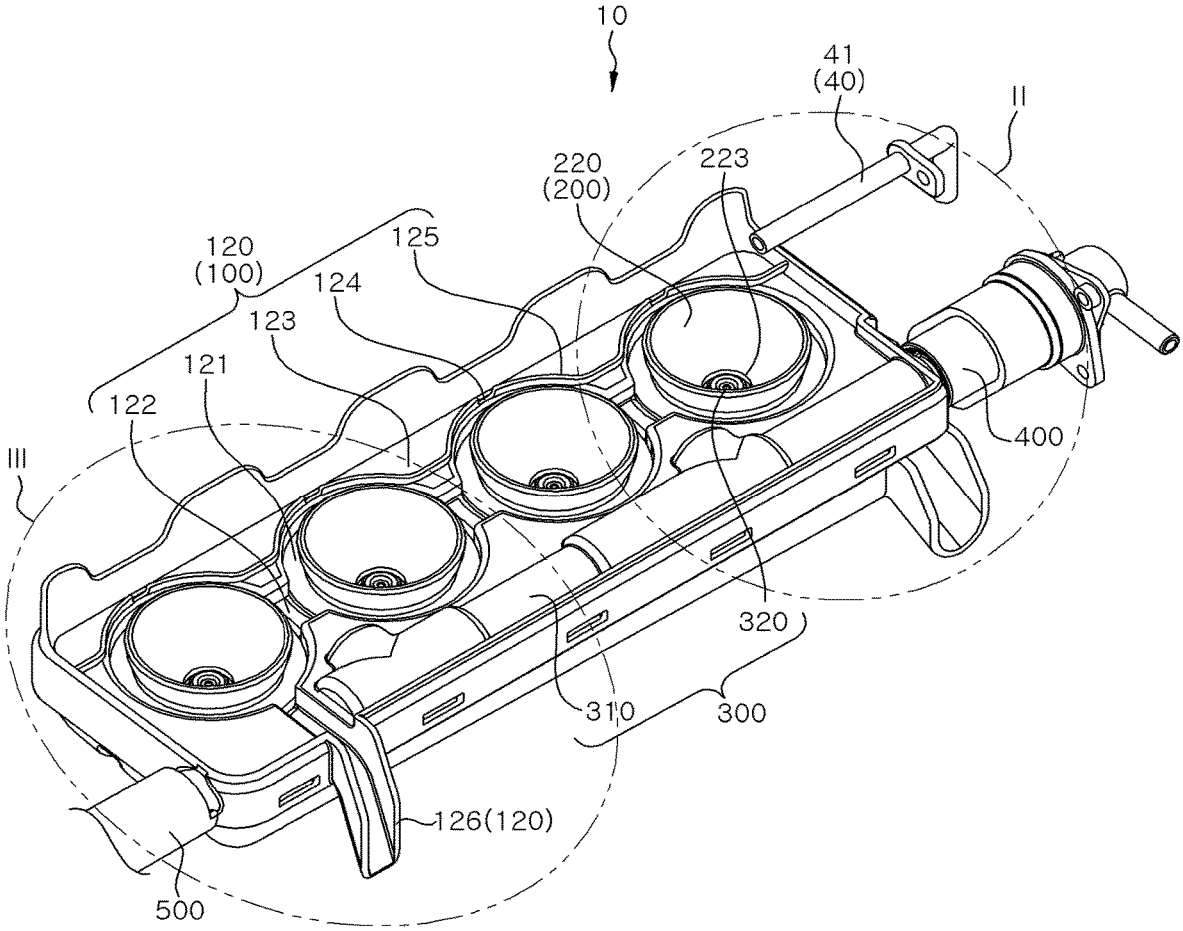
FIG. 6 is a view of a rotation frame of the ice making apparatus of FIG. 4.
Figure 7:
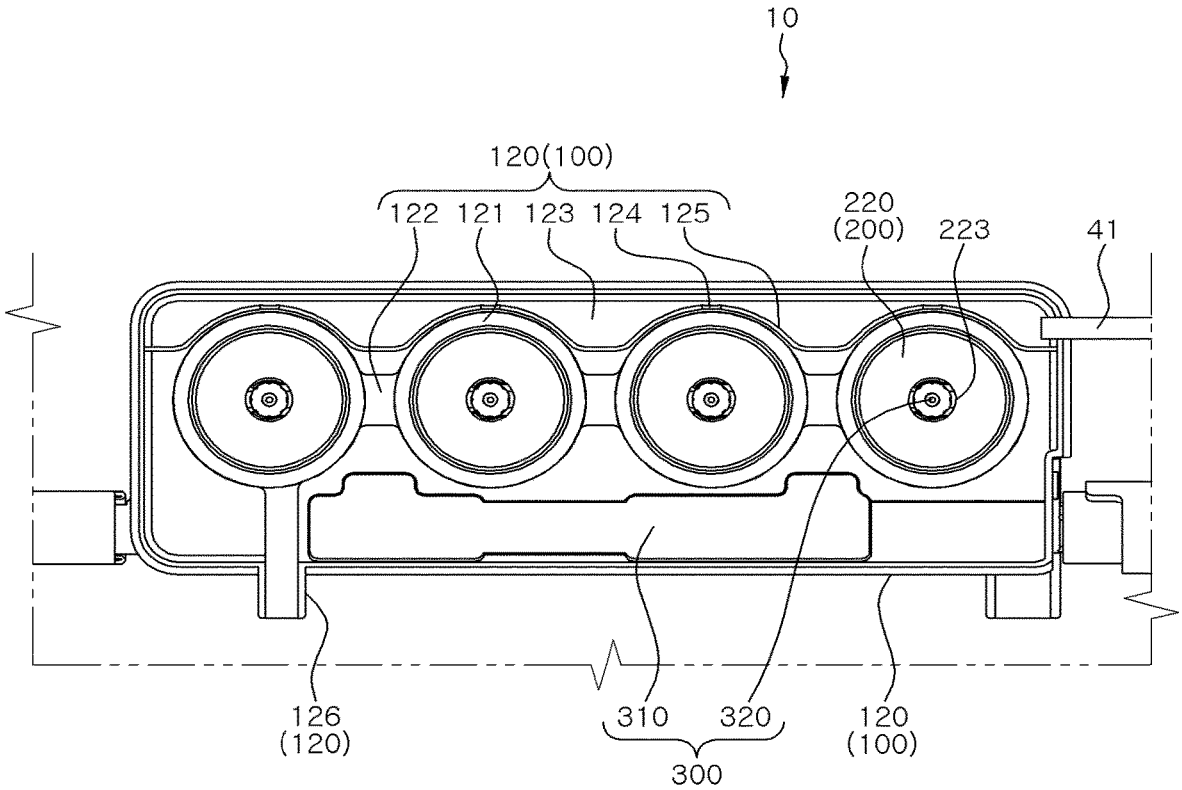
FIG. 7 is a view of the rotation frame of FIG. 6 viewed from an upper side thereof.

Referring to FIGS. 1 to 3, the ice making water purifier 1 may provide ice or beverages. This ice making water purifier 1 may include an ice making apparatus 10, a main tank 20, an auxiliary tank 30, a flow line 40, a pump 50, and a filter 60.

Referring to FIGS. 4 to 7, the ice making apparatus 10 may produce ice. This ice making apparatus 10 may include a frame assembly 100, an ice making cell 200, a spray module 300, an ice making water supply unit 400, and a driving unit 500.

The frame assembly 100 may accommodate the ice making cell 200 and the spray module 300. In addition, the driving unit 500 may be connected to one side of the frame assembly 100. The frame assembly 100 may include a support frame 110 and a rotation frame 120.

An upper ice making cell 210 of the ice making cell 200, which will be described later, may be supported on the support frame 110. For example, the upper end of the upper ice making cell 210 may be inserted into the support frame 110, and the lower end of the upper ice making cell 210 may be disposed on a lower side of the support frame 110. The rotation frame 120 may be rotatably connected to the support frame 110. For example, the support frame 110 may be disposed so that its posture and position are fixed to a housing that supports the auxiliary tank 30, and the rotation frame 120 may be rotatably connected to the support frame 110 whose posture and position are fixed.

The rotation frame 120 may be rotatably connected to the support frame 110 about a rotation axis extending in one direction. For example, the rotation frame 120 may be rotatably connected to the support frame 110 about the rotation axis so that the ice making cell 200 is closed or opened by movement of a lower ice making cell 220, which will be described later, of the ice making cell 200. When the rotation frame 120 is rotated away from the support frame 110, ice supported in the lower ice making cell 220 may be detached (discharged to the outside). The rotation frame 120 may include a water to melt ice flowing portion 121, a communication portion 122, a water to melt ice accommodation portion 123, a guide portion 124, a barrier 125, and an outlet 126.

A water to melt ice flow path for the water to melt ice to flow may be formed in the water to melt ice flowing portion 121. The water to melt ice may include room temperature water having a higher temperature than the ice in the lower ice making cell 220. The water to melt ice flowing portion 121 may be provided in plural numbers, and the plurality of water to melt ice flowing portions 121 may extend along the circumference of the plurality of lower ice making cells 220. For example, the water to melt ice flowing portion 121 may be extended to surround the circumference of a contact portion 222 of the lower ice making cell 220. Accordingly, when the temperature of the ice in the lower ice making cell 220 rises due to the water to melt ice in the water to melt ice flowing portion 121 and the rotation frame 120 is rotated away from the support frame 110, ice may be easily detached from the lower ice making cell 220. In the rotation frame 120, the water to melt ice flowing portion 121 adjacent to a nipple 41, which will be described later, of the flow line 40, may be disposed at a higher position than the water to melt ice flowing portion 121 adjacent to the outlet 126. The water to melt ice flowing portion 121 may include a bottom surface 121*a* and a side wall 121*b*.

The bottom surface 121*a* may be extended outward (horizontal direction in FIG. 8) from a protrusion 222 of the lower ice making cell 220. The bottom surface 121*a* may be the bottom of the water to melt ice flow path.

The side wall 121*b* may be extended upward from the bottom surface 121*a* (upper side in FIG. 8) to form a water to melt ice flow path together with the bottom surface 121*a*. The height of the side wall 121*b* may be lower than the height of the protrusion 222.

The communication portion 122 may provide a passage through which at least some of the plurality of water to melt ice flowing portions 121 communicate with each other. For example, the communication portion 122 may be disposed between the plurality of water to melt ice flowing portions 121 to provide a passage through which the water to melt ice in the plurality of water to melt ice flowing portions 121 communicates with each other and flows. The height of the communication portion 122 may be higher than the height of the water to melt ice flowing portion 121.

The water to melt ice accommodation portion 123 may accommodate water to melt ice supplied from the outside. For example, the water to melt ice accommodation portion 123 may accommodate water to melt ice supplied from the nipple 41 disposed on an upper side of the water to melt ice accommodation portion 123. The water to melt ice accommodation portion 123 may be disposed along the arrangement direction of the plurality of lower ice making cells 220 in the rotation frame 120. The water to melt ice accommodation portion 123 may be disposed at a higher position than the water to melt ice flowing portion 121 in the rotation frame 120.

The guide portion 124 may guide the water to melt ice in the water to melt ice accommodation portion 123 to flow to the water to melt ice flowing portion 121. For example, the guide portion 124 may be formed in a groove shape so that the water to melt ice in the water to melt ice accommodation portion 123 flows to the water to melt ice flowing portion 121.

The barrier 125 may be disposed between the water to melt ice accommodation portion 123 and the water to melt ice flowing portion 121 and extended to both sides of the guide portion 124. For example, the barrier 125 extends upward to a predetermined height between the water to melt ice accommodation portion 123 and the water to melt ice flowing portion 121 in the rotation frame 120 to allow the water to melt ice in the water to melt ice accommodation portion 123 to flow to the water to melt ice flowing portion 121 through the guide portion 124.

The outlet 126 may provide a passage through which water to melt ice flowing to the water to melt ice flowing portion 121 is discharged from the water to melt ice flowing portion 121 to the outside of the rotation frame 120. For example, the outlet 126 may be connected to and communicate with the water to melt ice flowing portion 121 disposed on one side (left side in FIG. 6) among the plurality of water to melt ice flowing portions 121 to provide a passage through which the water to melt ice is discharged to the outside. The outlet 126 may be disposed on an upper side of the auxiliary tank 30, so that the water to melt ice discharged through the outlet 126 can be accommodated in the auxiliary tank 30.

Figure 8:
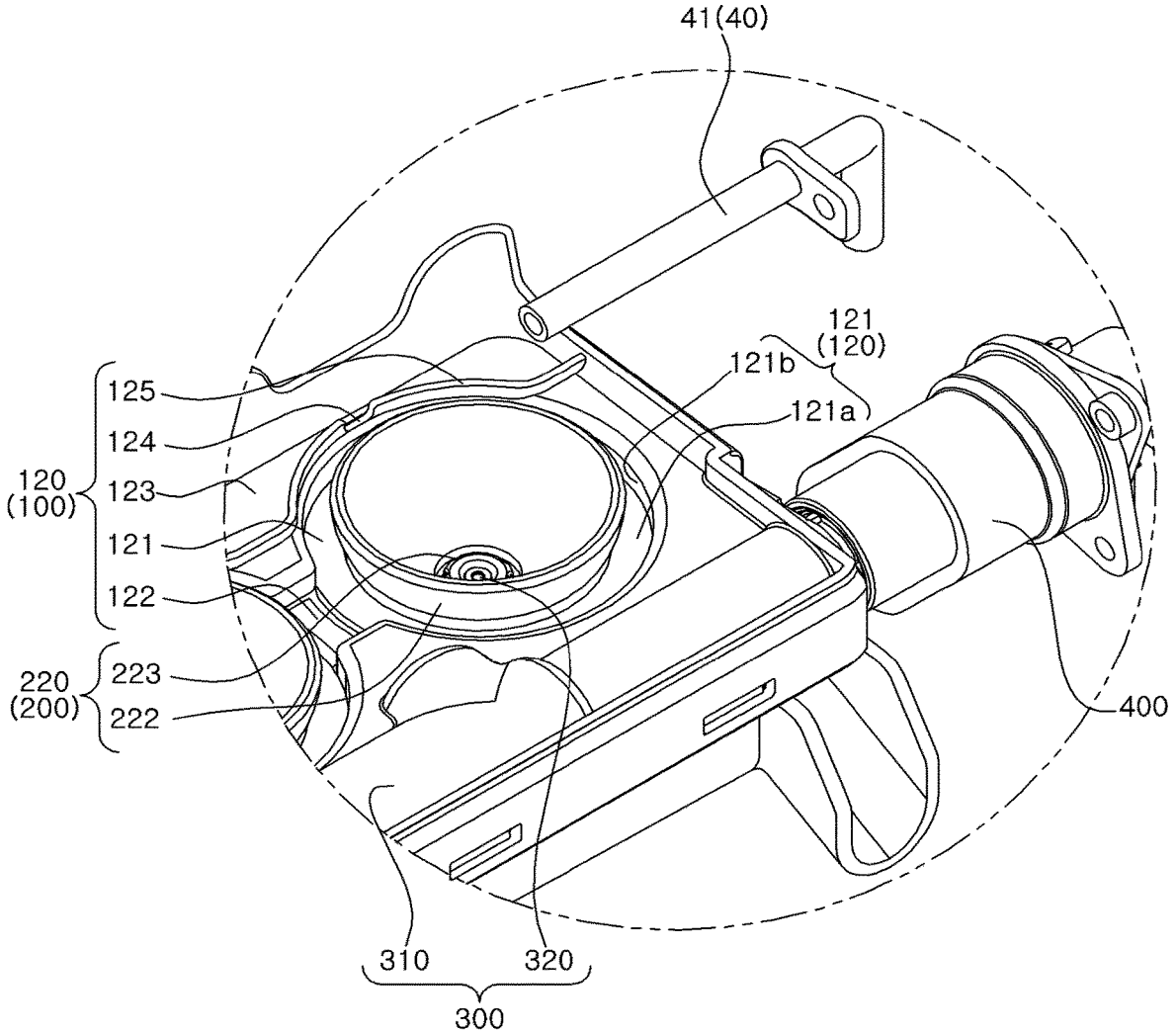
FIG. 8 is an enlarged view of II of FIG. 6.
Figure 9:
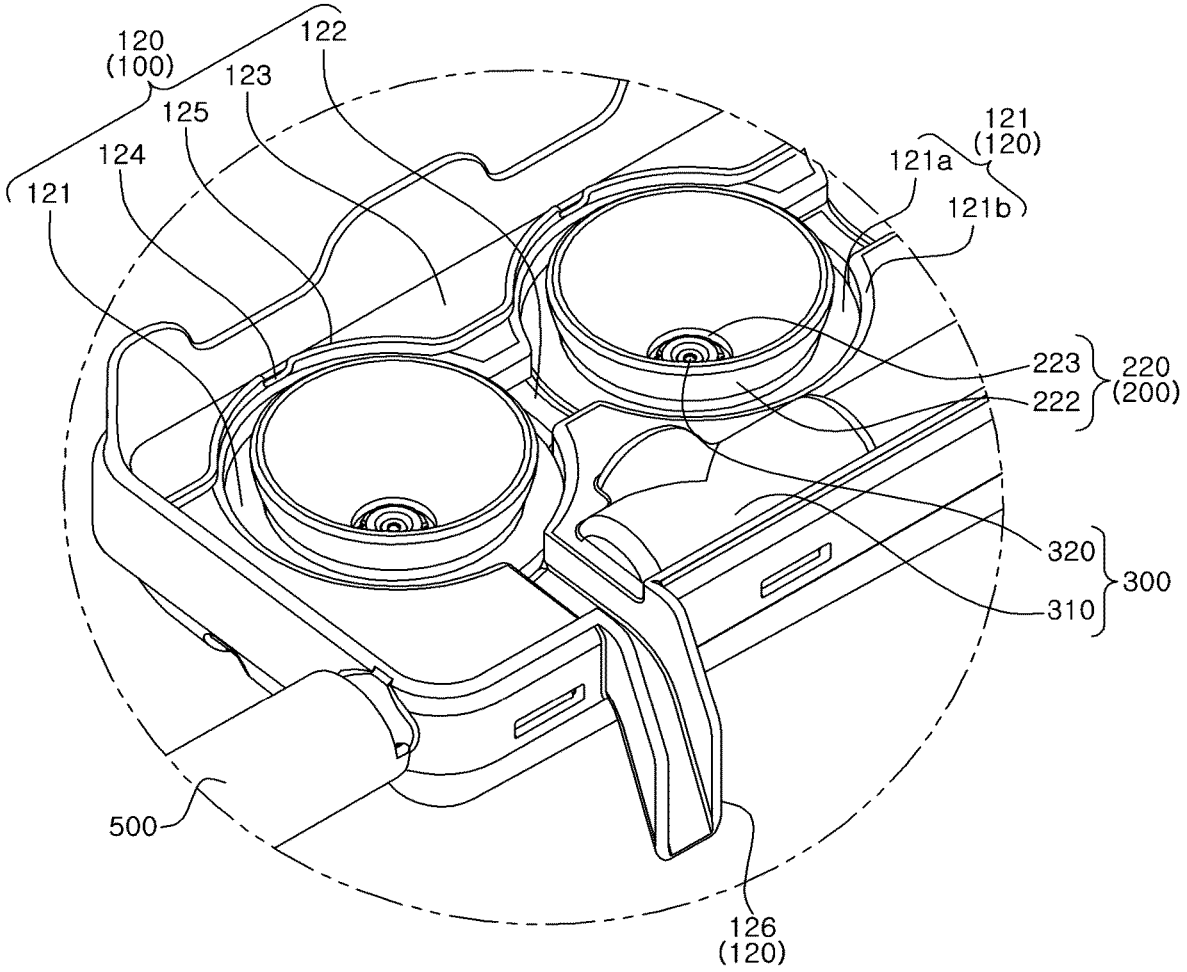
FIG. 9 is an enlarged view of III of FIG. 6.

Referring to FIGS. 8 and 9, the ice making cell 200 may produce a part of the ice. The ice making cells 200 may be provided in plural numbers, and the plurality of ice making cells 200 may be arranged along the extension direction of the frame assembly 100. The ice making cell 200 may include the upper ice making cell 210 and the lower ice making cell 220.

The upper ice making cell 210 may cover an upper portion of the ice and may be supported on the support frame 110. An evaporator (not shown) that cools the ice water sprayed into the upper ice making cell 210 by the spray module 300 may be disposed on a portion of the outer peripheral surface of the upper ice making cell 210. The upper ice making cell 210 may be made of a metal. The upper ice making cells 210 may be provided in plural numbers, and the plurality of upper ice making cells 210 may be arranged from one side of the support frame 110 to the other side.

The lower ice making cell 220 may cover a lower portion of the ice and may be supported on the rotation frame 120. As the lower ice making cell 220 is moved by rotating the rotation frame 120 about the rotation axis with respect to the support frame 110, the ice making cell 200 may be closed or opened. The lower ice making cell 220 may be made of metal or plastic. The lower ice making cells 220 may be provided in plural numbers, and the plurality of lower ice making cells 220 may be arranged from one side of the rotation frame 120 to the other side. The lower ice making cell 220 may include a non-contact portion 221, a contact portion 222, and an opening 223.

The non-contact portion 221 may be inserted into the rotation frame 120 and not exposed to water to melt ice. For example, when viewed in the horizontal direction, the non-contact portion 221 may be introduced into the interior side of the rotation frame 120 so as to be separated from the water to melt ice flowing portion 121 and may not contact the water to melt ice.

The contact portion 222 may be disposed on an upper side of the non-contact portion 221 and may be in contact with water to melt ice. For example, when viewed in the horizontal direction, the contact portion 222 may protrude toward an upper side of the rotation frame 120 and may be surrounded by the water to melt ice flowing portion 121. The height of the contact portion 222 may be higher than a water level of the water to melt ice in the water to melt ice flowing portion 121. For example, water to melt ice may contact an outer peripheral surface of the contact portion 222 at a lower height than an upper end of the outer peripheral surface of the contact portion 222. In other words, the water to melt ice contacts only the outer peripheral surface of the contact portion 222 at a relatively low height to increase the temperature of the ice in the lower ice making cell 220, thereby detaching the ice.

The opening 223 may be disposed at a lower portion of the lower ice making cell 220 and may communicate with the outside. A nozzle 320, which will be described later, of the spray module 300 may be inserted into the opening 223, and ice making water may be sprayed into the upper ice making cell 210 and the lower ice making cell 220 by the nozzle 320.

A flow path through which ice making water provided to the ice making cell 200 flows may be formed in the spray module 300. For example, the spray module 300 may be connected to the ice making water supply unit 400 to spray ice making water supplied from the ice making water supply unit 400 into the ice making cell 200. The spray module 300 may be disposed along the extension direction of the rotation axis of the driving unit 500. This spray module 300 may include a flow path portion 310 and the nozzle 320.

A flow path through which ice making water provided to the ice making cell 200 flows may be formed in the flow path portion 310. For example, ice making water supplied from the ice making water supply unit 400 may flow to the nozzle 320 through the flow path portion 310. This flow path portion 310 may be rotated about the rotation axis when the rotation frame 120 is rotated with respect to the support frame 110. Additionally, the flow path portion 310 may be rotatably connected to the ice making water supply unit 400. For example, when rotated with respect to the rotation axis, the flow path portion 310 may rotate with respect to the ice making water supply unit 400 whose posture and position are fixed.

The nozzle 320 may spray ice making water into the ice making cell 200. For example, the nozzle 320 may spray ice making water introduced from the flow path portion 310 into the upper ice making cell 210 and the lower ice making cell 220. The nozzle 320 may be supported within the rotation frame 120 and may rotate together with the rotation frame 120 when the rotation frame 120 rotates with respect to the support frame 110.

The ice making water supply unit 400 may provide a passage through which the ice making water supplied to the flow path portion 310 flows. For example, the ice making water supply unit 400 may receive ice making water from the main tank 20 through the flow line 40 and provide a passage through which the ice making water flows to the flow path portion 310. The ice making water supply unit 400 may be disposed along the rotation axis on one side (right side in FIG. 3) of the rotation frame 120.

The driving unit 500 may rotate the rotation frame 120 about the rotation axis. This driving unit 500 may be disposed on the other side of the rotation frame 120 (left side in FIG. 3), which is the opposite side of the ice making water supply unit 400.

The main tank 20 may accommodate water to melt ice to be provided to the ice making apparatus 10. For example, the flow line 40 may be connected to one side of the main tank 20, and the water to melt ice in the main tank 20 may be discharged to the water to melt ice accommodation portion 123 through the nipple 41 of the flow line 40. The main tank 20 may be in communication with the auxiliary tank 30. For example, among the water to melt ice accommodated in the auxiliary tank 30, the water to melt ice that exceeds a preset capacity may flow from the auxiliary tank 30 to the main tank 20.

The auxiliary tank 30 may accommodate water to melt ice discharged from the outlet 126 disposed on an upper side of the auxiliary tank 30. The auxiliary tank 30 may be in communication with the main tank 20. For example, when the water to melt ice in the auxiliary tank 30 exceeds the preset capacity, the excess water to melt ice may flow to the main tank 20. The main tank 20 and the auxiliary tank 30 may be formed integrally.

The flow line 40 may provide water to melt ice in the main tank 20 to a providing device. One side of the flow line 40 may be connected to the water to melt ice accommodation portion 123. The flow line 40 may include the nipple 41 and a circulation channel 42.

The nipple 41 may receive water to melt ice from the main tank 20 through the circulation channel 42 and discharge the same into the water to melt ice accommodation portion 123. The nipple 41 may be disposed on an upper side of the water to melt ice accommodation portion 123 disposed on one side (right side in FIG. 8) of the rotation frame 120 and may discharge water to melt ice into the water to melt ice accommodation portion 123.

The circulation channel 42 may provide a path through which water to melt ice flows from the main tank 20 to the nipple 41. For example, one side of the circulation channel 42 may be connected to and communicate with the main tank 20, and the other side may be connected to and communicate with the nipple 41.

The pump 50 may be disposed in the circulation channel 42 and may pressurize the water to melt ice introduced into the circulation channel 42 from the main tank 20 to flow the same to the nipple 41. The pump 50 may provide sufficient pressure to flow the water to melt ice.

The filter 60 may filter raw water and provide purified water for producing ice. The raw water may refer to water supplied from outside, and the purified water may refer to raw water that has passed through the filter 60.

Hereinafter, the operation and benefits of the ice making water purifier 1 having the aforementioned configuration will be described.

The water to melt ice flowing portion 121 of the rotation frame 120 may form a water to melt ice flow path through which water to melt ice flows, and may be extended along the circumference of the plurality of lower ice making cells 220. Accordingly, the structure of the ice making apparatus 10 can be simplified. In addition, the temperature of the ice in the lower ice making cell 220 increases due to the water to melt ice of the water to melt ice flowing portion 121. When the rotation frame 120 is rotated away from the support frame 110, the ice may be easily detached from the lower ice making cell 220 (discharged to the outside).

Additionally, the communication portion 122 may be disposed between the plurality of water to melt ice flowing portions 121 to provide a passage through which the water to melt ice in the plurality of water to melt ice flowing portions 121 communicates with each other and flows. Accordingly, by flowing a uniform amount of water to melt ice in the plurality of water to melt ice flowing portions 121, the ice in the plurality of lower ice making cells 220 may be heated to a uniform temperature.

In addition, the contact portion 222 may be disposed on an upper side of the non-contact portion 221 and contact the water to melt ice, and the height of the contact portion 222 may be set to be higher than a water level of the water to melt ice in the water to melt ice flowing portion 121. Accordingly, even when the water to melt ice contacts only the outer peripheral surface of the contact portion 222 at a relatively low height, the temperature of the ice in the lower ice making cell 220 increases and the ice can be easily detached.

Further, in the rotation frame 120, the water to melt ice flowing portion 121 adjacent to the nipple 41 may be disposed at a higher position than the water to melt ice flowing portion 121 adjacent to the outlet 126. Accordingly, the water to melt ice can easily flow from the water to melt ice flowing portion 121 adjacent to the nipple 41 to the water to melt ice flowing portion 121 adjacent to the outlet 126, and can be discharged to the auxiliary tank 30 through the outlet 126.

In addition, the water to melt ice discharged to the auxiliary tank 30 through the outlet 126 can be discharged to the water to melt ice accommodation portion 123 through the main tank 20 in communication with the auxiliary tank 30, the circulation channel 42 of the flow line 40, and the nipple 41. Accordingly, the water to melt ice for detaching the ice from the lower ice making cell 220 can be recirculated.

The examples of the present disclosure have been described above as specific embodiments, but these are merely examples, and the present disclosure is not limited thereto, and should be construed as having the widest scope according to the technical idea disclosed in the present specification. Those skilled in the art may combine/substitute the disclosed embodiments to implement a pattern of a shape that is not disclosed, but it does not depart from the scope of the present disclosure, either. In addition, those skilled in the art can easily change or modify the disclosed embodiments based on the present specification, and it is clear that such changes or modifications also belong to the scope of the present disclosure.

What is claimed is:

1. An ice making apparatus comprising:

a frame assembly including a support frame and a rotation frame rotatably connected to the support frame; and one or more ice making cells that produce ice, wherein the ice making cell includes an upper ice making cell that covers a portion of the ice and is supported on the support frame, and a lower ice making cell that covers another portion of the ice and is supported on the rotation frame;

wherein the rotation frame includes a water to melt ice flowing portion having a water to melt ice flow path through which water to melt ice at a higher temperature than that of the ice in the lower ice making cell flows, wherein the lower ice making cell includes a non-contact portion that is inserted into an interior side of the rotation frame so as not to be exposed to the water to melt ice, and a contact portion disposed on an upper side of the non-contact portion to contact the water to melt ice, the contact portion protruding toward an upper side of the rotation frame, wherein the water to melt ice flowing portion includes a bottom surface extending outward in a horizontal direction from the contact portion, and a side wall extending upward from the bottom surface to form the water to melt ice flow path with the bottom surface, a height of the side wall being lower than a height of the contact portion, wherein the water to melt ice flowing portion surrounds at least a portion of the contact portion, the height of the contact portion being higher than a water level of the water in the water to melt ice flowing portion, and wherein the rotation frame further includes:

a water to melt ice accommodation portion that accommodates the water to melt ice supplied from an outside, the water to melt ice accommodation portion being disposed at a higher position than the water to melt ice flowing portion, the water to melt ice accommodation portion including an arcuate portion and a straight portion, a guide portion that guides the water to melt ice in the water to melt ice accommodation portion to flow to the water to melt ice flowing portion, the guide portion being disposed at the arcuate portion, and a barrier disposed between the water to melt ice accommodation portion and the water to melt ice flowing portion to extend to both sides of the guide portion wherein the barrier has a curvature corresponding to a curvature of an end portion of the lower ice making cell, and the guide portion is disposed at a portion of the barrier having the curvature.

2. The ice making apparatus of claim 1, wherein the lower ice making cell and the water to melt ice flowing portion are provided in plural numbers;

wherein the plurality of water to melt ice flowing portions are extended along a circumference of the plurality of lower ice making cells; and wherein the rotation frame further includes a communication portion that provides a passage through which at least some of the plurality of water to melt ice flowing portions communicate with each other.

3. The ice making apparatus of claim 1, wherein the rotation frame further includes an outlet providing a passage for the water to melt ice flowing in the water to melt ice flowing portion to be discharged from the water to melt ice flowing portion to an outside of the rotation frame.

4. An ice making water purifier comprising:

an ice making apparatus that produces ice; and a filter that filters raw water to provide purified water to produce the ice, wherein the ice making apparatus comprises:

a frame assembly including a support frame and a rotation frame rotatably connected to the support frame; and one or more ice making cells that produce a part of the ice, wherein the ice making cell includes an upper ice making cell that covers a portion of the ice and is supported on the support frame, and a lower ice making cell that covers another portion of the ice and is supported on the rotation frame, wherein the rotation frame includes a water to melt ice flowing portion having a water to melt ice flow path through which water to melt ice at a higher temperature than that of the ice in the lower ice making cell flows, wherein the lower ice making cell includes a non-contact portion that is inserted into an interior side of the rotation frame so as not to be exposed to the water to melt ice, and a contact portion disposed on an upper side of the non-contact portion to contact the water to melt ice, the contact portion protruding toward an upper side of the rotation frame, wherein the water to melt ice flowing portion includes a bottom surface extending outward in a horizontal direction from the contact portion, and a side wall extending upward from the bottom surface to form the water to melt ice flow path with the bottom surface, a height of the side wall being lower than a height of the contact portion, wherein the water to melt ice flowing portion surrounds at least a portion of the contact portion, the height of the contact portion being higher than a water level of the water in the water to melt ice flowing portion, and wherein the rotation frame further includes:

a water to melt ice accommodation portion that accommodates the water to melt ice supplied from an outside, the water to melt ice accommodation portion being disposed at a higher position than the water to melt ice flowing portion, the water to melt ice accommodation portion including an arcuate portion and a straight portion, a guide portion that guides the water to melt ice in the water to melt ice accommodation portion to flow to the water to melt ice flowing portion, the guide portion being disposed at the arcuate portion, and a barrier disposed between the water to melt ice accommodation portion and the water to melt ice flowing portion to extend to both sides of the guide portion, wherein the barrier has a curvature corresponding to a curvature of an end portion of the lower ice making cell, and the guide portion is disposed at a portion of the barrier having the curvature.

5. The ice making water purifier of claim 4, further comprising:

a main tank accommodating the water to melt ice to be provided to the ice making apparatus; and an auxiliary tank in communication with the main tank, wherein the rotation frame further includes an outlet providing a passage for the water to melt ice flowing in the water to melt ice flowing portion to be discharged from the water to melt ice flowing portion to an outside of the rotation frame, and wherein the auxiliary tank accommodates the water to melt ice discharged from the outlet, and when the water to melt ice exceeds a preset capacity, the excess water to melt ice flows from the auxiliary tank to the main tank.

6. The ice making water purifier of claim 5, wherein the ice making water purifier further comprises:

a nipple that receives the water to melt ice through the main tank and supplies the received water to melt ice to the water to melt ice accommodation portion; and a circulation channel that provides a path for the water to melt ice to flow from the main tank to the nipple.

7. The ice making water purifier of claim 6, wherein the water to melt ice flowing portion adjacent to the nipple is disposed at a higher position than the water to melt ice flowing portion adjacent to the outlet.

* * * * *